United States Patent [19]

Nakazawa

[11] Patent Number: 4,591,541

[45] Date of Patent: May 27, 1986

[54] PROCESS FOR THE PREVENTION OF THE MEMORY EFFECT IN AN ORGANIC PHOTOCONDUCTOR LAYER IN AN ELECTROPHOTOGRAPHIC PROCESS

[75] Inventor: Toru Nakazawa, Sennan, Japan

[73] Assignee: Mita Industrial Co., Ltd., Osaka, Japan

[21] Appl. No.: 625,535

[22] Filed: Jun. 28, 1984

[30] Foreign Application Priority Data

Jun. 30, 1983 [JP] Japan ..... 58-117091

[51] Int. Cl.[4] ..... G03G 13/16

[52] U.S. Cl. ..... 430/59; 430/122; 430/126

[58] Field of Search ..... 430/49, 122, 59, 126

[56] References Cited

U.S. PATENT DOCUMENTS 4,057,016 11/1977 Endo et al. ..... 430/49

FOREIGN PATENT DOCUMENTS 56-16154 2/1981 Japan .

*Primary Examiner*—John L. Goodrow

*Attorney, Agent, or Firm*—Wenderoth, Lind & Ponack

[57] ABSTRACT

An electrophotographic process includes performing main charging by direct current corona discharge and imagewise exposure on an organic photoconductive photosensitive layer chargeable at both positive and negative polarities, developing a formed electrostatic image with a magnetic brush of a toner, bringing the photosensitive layer bearing a toner image thus formed thereon into contact with a copying sheet, performing transfer of the toner by direct current corona discharge of the same polarity as that of the main charging step applied to the back surface of the copying sheet, and cleaning the photosensitive layer, from which the toner has been transferred, with the magnetic brush after removal of residual charge. The injected current of the direct current corona discharge during the transfer of the toner is set at a level 23 to 35 times the injected current initiating the transfer of the toner. After the transfer of the toner, the photosensitive layer is subjected to direct current corona discharge of a polarity reverse to the polarity of the direct current corona discharge for main charging to charge the residual at a uniform polarity.

5 Claims, 7 Drawing Figures

PROCESS FOR THE PREVENTION OF THE MEMORY EFFECT IN AN ORGANIC PHOTOCONDUCTOR LAYER IN AN ELECTROPHOTOGRAPHIC PROCESS

SUMMARY OF THE INVENTION

The present invention relates to an electrophotographic process using an organic photoconductive photosensitive layer. More particularly, the invention relates to an electrophotographic process in which a memory effect generated when an electrostatic image is formed on an organic photoconductive photosensitive material and such operations as toner development, transfer and cleaning are repeated is eliminated and clear images are always formed.

In accordance with the present invention, there is provided an electrophotographic process comprising performing main charging by direct current corona discharge and imagewise exposure on an organic photoconductive photosensitive layer chargeable at both the positive and negative polarities, developing a formed electrostatic image with a magnetic brush of toner, bringing the photosensitive layer bearing a toner image thus formed thereon into contact with a copying sheet, performing transfer of the toner image by direct current corona discharge at the same polarity as that of the main charging step applied to the back surface of the copying sheet, and cleaning the photosensitive layer from which the toner has been transferred with the magnetic brush after removal of residual charge. The injected or applied current of the direct current corona discharge at the step of the transfer of the toner is set at a level 23 to 35 times the injected current initiating the transfer of the toner. After the transfer of the toner the photosensitive layer is subjected to direct current corona discharge of a polarity reverse to the polarity of the direct current corona discharge for main charging to charge the residual toner with a uniform polarity.

DETAILED DESCRIPTION OF THE INVENTION

Figure 1:
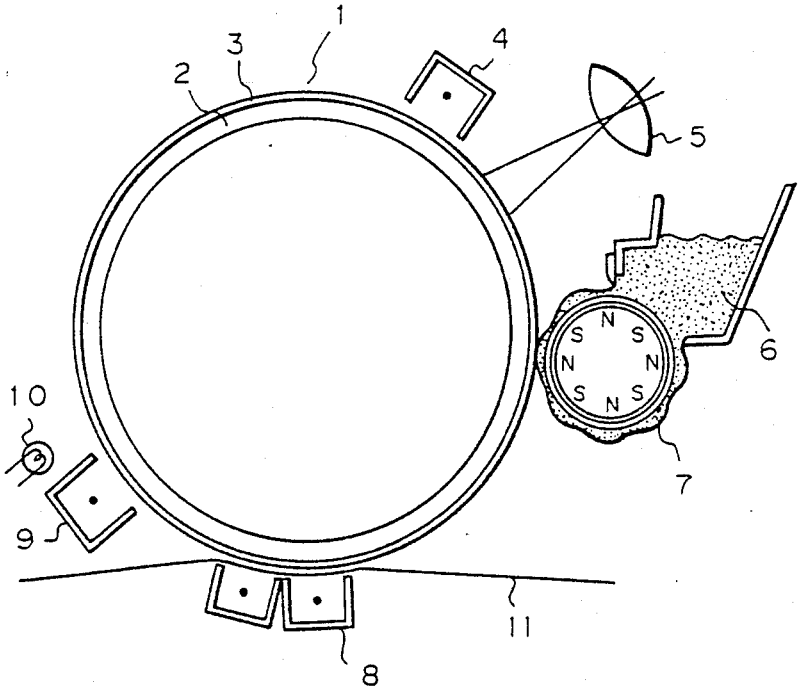
FIG. 1 is a schematic view illustrating an electrophotographic process.

Referring to FIG. 1 illustrating an apparatus for carrying out the electrophotographic process to which the present invention is directed, a photoconductive photosensitive layer 3 is formed on the surface of an electroconductive substrate 2 of a rotary drum 1. Along the surface of this drum 1, a direct current corona charger 4 for main charging, an optical system 5 for imagewise exposure, a magnetic brush developing and cleaning mechanism for forming a magnetic brush 7 and for retaining toner 6, a direct current corona charger 8 for image transfer, a direct current corona charger 9 and a light source 10 for removing residual charge are arranged in this order.

In a reproduction operation, the photosensitive layer 3 is charged at a certain polarity by the main charger 4 and imagewise exposure is performed through the optical system 5 to form an electrostatic image corresponding to an original image. The photosensitive layer 3 is brought into sliding contact with the magnetic brush 7 of the toner 6 charged at a polarity reverse to the polarity of the electrostatic image, whereby a toner image corresponding to the electrostatic image is formed on the photosensitive layer 3.

A transfer sheet 11 is supplied to the surface of the photosensitive layer 3 bearing the toner image thereon, and corona discharge is applied to the back surface of the transfer sheet 11 by the charger 8 for transfer, whereby the toner image is transferred onto the surface of the copying sheet 11. The transfer sheet 11 on which the toner image has been transferred is peeled from the photosensitive layer 3 and is fed to a fixing mechanism (not shown), in which the toner image is fixed and a print is obtained.

After the transfer of the toner image, there remains on the layer 3 a certain amount of residual toner determined by the transfer efficiency. Since the toner has passed through the transfer step, the toner particles are irregularly charged. In order to uniformalize the charge of the toner particles, direct current corona charging of a polarity reverse to the main charging is performed by the corona charger 9, and in order to remove the charge left in the photosensitive layer, the entire surface is exposed to light from the light source 10. In this charge-removed state, the photosensitive layer 3 is brought into sliding contact with the magnetic brush 7, whereby the charged toner particles on the photosensitive layer 3 are attracted onto the magnetic brush 7 and cleaning is accomplished.

As is apparent from the foregoing illustration, in the above-mentioned process, during a first rotation of the drum development is accomplished with the magnetic brush 7, and during a second rotation of the drum cleaning is accomplished with the magnetic brush 7. One cycle of the copying operation is completed by two rotations of the drum. Accordingly, a necessary number of prints can be obtained by repeating this copying operation cycle the necessary number of times.

It has been found that when this electrophotographic process is carried out by using an organic photoconductive photosensitive layer chargeable at both polarities, there arises a serious problem not observed when an inorganic photoconductive layer of selenium or cadmium sulfide is used. Namely, a memory is formed at the step of forming the image during a first cycle and appears in the second cycle and subsequent cycles. It is considered that the reason is that, since an organic photoconductive photosensitive layer has a larger dielectric constant than an inorganic photoconductive photosensitive layer and a carrier having an extremely long life is formed, transfer of toner or removal of toner by cleaning is difficult.

As the result of research made by the inventor, it is presumed that this memory effect will probably be caused according to the principle shown in FIGS. 2A–2E. At the developing step shown in FIG. 2A, the image area of the photosensitive layer 3 is positively charged, and the negatively charged toner 6 adheres to this positively charged area. At the subsequent transfer step shown in FIG. 2B, the copying sheet 11 is placed on the photosensitive layer 3 and positive charging is effected from the back surface of the copying sheet 11 by the charger 8, whereby the negatively charged toner 6 is transferred to the transfer sheet 11. However, at this point, a certain amount of toner 6' is provided with substantially zero charged by ths positive charging through the copying sheet 11, and another amount of toner 6'' is positively charged by this positive charging. These particles of zero-charged toner 6' and positively charged toner 6'' remain on the photosensitive layer 3.

Figure 2A:
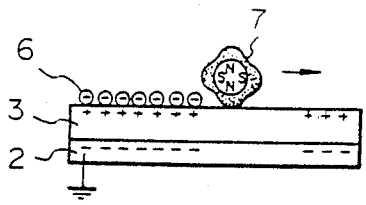
FIGS. 2A–2E are schematic views illustrating the principle of the present invention.
Figure 2B:
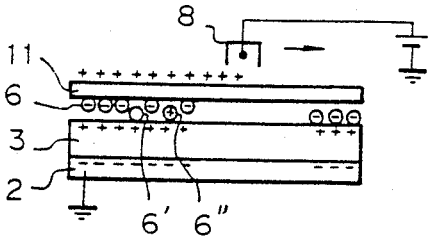
Figure 2C:
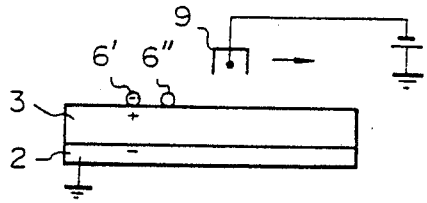

At the charge removing step shown in FIG. 2C, negative charging by the charger 9 and light exposure by the lamp 10 are carried out, and the substantially zero-charged toner 6' is negatively charged and the positively charged toner 6'' becomes substantially zero charged because of cancellation of the charge.

Figure 2D:
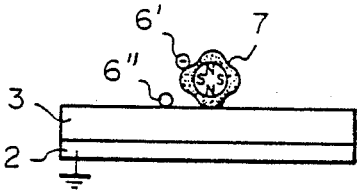

At the subsequent cleaning step shown in FIG. 2D, the photosensitive layer 3 is brought into contact with the magnetic brush 7. At this point, the negatively charged toner 6' is attracted to the magnetic brush by the Coulomb force acting between the magnetic brush and magnetic carrier, but the non-charged toner 6'' is left on the photosensitive layer 3 because such a Coulomb force does not act.

Figure 2E:
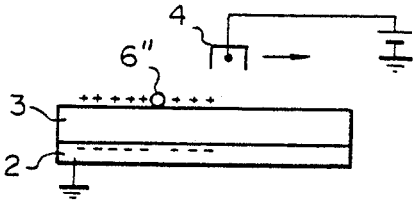

At the following main charging step shown in FIG. 2E, when positive charging is effected by charger 4 on the photosensitive layer 3 carrying the toner 6'' left thereon, charging with a positive polarity is effectively performed in portions where cleaning of the toner was complete. However, charging with a positive polarity is insufficient in portions where the zero-charge toner 6'' remains. Accordingly, on portions of layer 3 where the toner 6'' remains, only an image having a low density is developed during the subsequent cycle.

Because of this memory effect, in the second cycle, extreme reduction of the image density is caused in portions of the photosensitive layer corresponding to the solid black portion of the first cycle.

According to the present invention, the injected or applied current of the direct current corona discharge at the step of the transfer of the toner image is set at a level 23 to 35 times the injected or applied current initiating the transfer of the toner, whereby formation of the toner particles 6'' strongly charged at the polarity of the transfer corona discharge by this corona discharge is prevented at the transfer step shown in FIG. 2B, and it is made possible to charge the residual toner particles at a uniform polarity during the charge removing step shown in FIG. 2C. Accordingly, all the residual toner can be attracted to the magnetic brush and the above-mentioned memory effect is eliminated.

Figure 3:
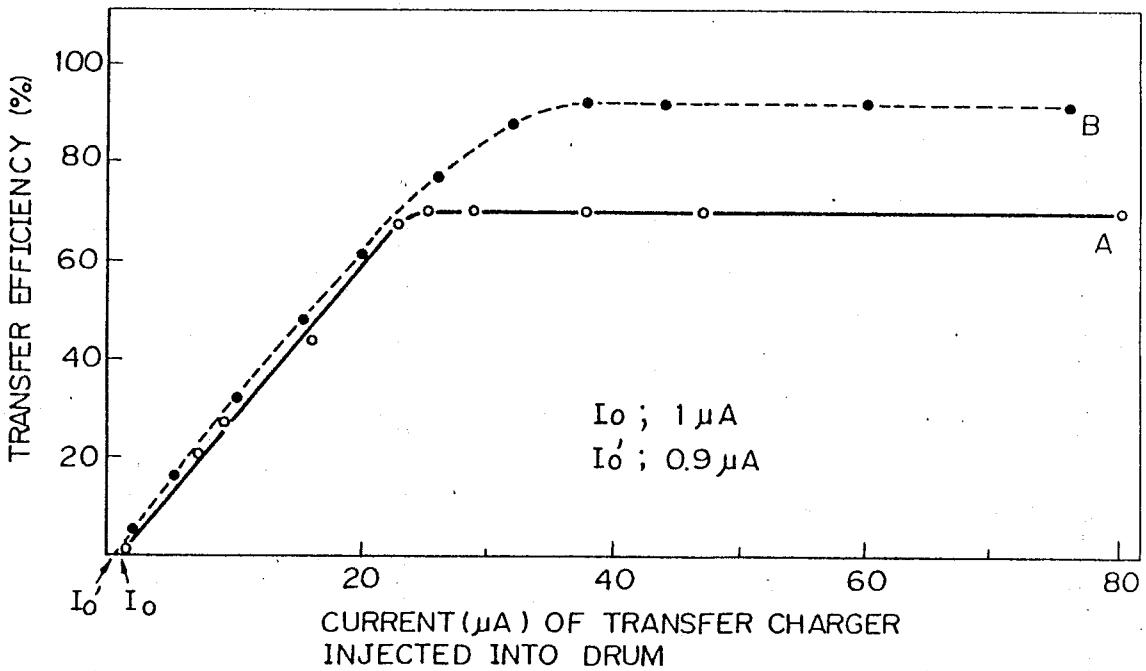
FIG. 3 is a diagram illustrating the relation between the injected or applied current of a transfer charger and the transfer efficiency.

When the set injected current of the corona charger for transfer and the toner transfer efficiency are plotted in the case of an organic photoconductive photosensitive layer chargeable at both the polarities, a curve A shown in FIG. 3 is obtained. More specifically, the transfer of the toner is caused when the injected current arrives at a certain level Io initiating the transfer, which is inherent to the photosensitive layer, and as the injected current is then increased, the toner transfer efficiency is increased. However, if the injected current value exceeds a certain level, the transfer efficiency is not increased further and the transfer efficiency is saturated at a certain value. This injected current Io initiating the transfer differs according to the type of the photosensitive layer, but a tendency similar to that of the curve A is ordinarily observed and the saturation value of the transfer efficiency is ordinarily in the range of from 65 to 75%.

In the case of an inorganic photoconductive photosensitive layer of selenium or the like, the relation between the set injected current of the corona charger for transfer and the toner transfer efficiency is as expressed by a curve B shown in FIG. 3. The transfer of the toner is started at an initiating injected current value Io' smaller than the initiating injected current value Io of the organic photosensitive layer, the toner transfer efficiency is saturated at a current value larger than the saturation current value in case of the organic photosensitive layer, and the saturation value of the transfer efficiency is as high as 90 and 97%.

Accordingly, in the conventional toner transfer system, in order to increase the transfer efficiency, the injected current of the charger for transfer is set at a level 40 to 66 times the injected current initiating the transfer.

If this set injected current value is used for the transfer of the toner from the organic photosensitive layer, the toner may be transferred at a high efficiency, but as pointed out hereinbefore, adverse influences are brought about by reverse polarity charging of the residual toner. In contrast, according to the present invention, by setting the injected current at a level 23 to 35 times the initiating injected current Io, adverse influences by reverse polarity charging of the residual toner on the photosensitive layer can be eliminated without substantial reduction of the toner transfer efficiency.

In the present invention, if the set injected current is lower than a level 23 times the initiating injected current Io, reduction of the image density due to reduction of the transfer efficiency and disturbance of the formed image due to insufficient transfer are caused. If the set injected current is higher than a level 35 times the initiating injected current Io, the memory effect due to reverse polarity charging of the residual toner on the photosensitive layer is caused.

In the present invention, it is difficult to directly measure an absolute value of the injected current of the transfer charger into the photosensitive layer. However, if a metal surface is employed instead of a photosensitive layer and the current injected from the charger is measured, it becomes possible to set the current value. Furthermore, the injected current initiating the transfer of the toner can easily be determined by setting the injected current value by the above-mentioned method, checking whether or not the transfer of the toner is caused at this set injected current with respect to each sample photosensitive layer, determining the transfer efficiency and plotting the relation between the set injected current and transfer efficiency.

The injected current of the transfer charger can be set at an optional level by known means. For example, since the injected current is substantially proportional to the applied voltage of the charger, the injected current can be set at an optional level by adjusting the applied voltage. Furthermore, since the injected current is decreased by increasing the distance between the photosensitive layer and corona wire and the injected current is increased by decreasing such distance. the injected current can be adjusted by controlling this distance.

All organic photoconductive photosensitive layers chargeable at both the polarities can be used in the process of the present invention, but especially excellent effects can be obtained when the organic photosensitive layer comprises a layer of a dispersion of a charge-generating pigment in a charge-transporting medium, which is formed on an electroconductive substrate. A photoconductive organic pigment such as a perylene type pigment, a quivacridone type pigment, a pyranthrone type pigment, a phthalocyanine type pigment, a disazo type pigment or a trisazo type pigment may be used as the charge-generating pigment, and a charge-transporting resin such a polyvinyl carbazole or a resin dispersion of a low-molecular-weight charge-transporting substance such as a hydrazone derivative or a pyrazoline type derivative may be used as the charge-transporting medium.

The present invention will now be described in detail with reference to the following example that by no means limits the scope of the invention.

EXAMPLE (1) Preparation of Photosensitive Material

| | |
|---|---|
| N,N'—Di(3,5-dimethylphenyl)perylene-3,4,9,10-tetracarboxylic acid diimide | 8 parts by weight |
| 2,3-Dichloro-1,4-naphthoquinone | 20 parts by weight |
| Phenanthrene | 60 parts by weight |
| Cyclohexane | 200 parts by weight |
| Tetrahydrofuran | 300 parts by weight |

The above components were charged in a stainless steel ball mill and dispersed at 60 rpm for 12 hours to obtain a homogeneous dispersion.

Then, 100 parts by weight of poly-N-vinyl carbazole (Luvican M-170 supplied by BASF AG), 10 parts by weight of a polyester resin (Vylon 200 supplied by Toyobo K.K.) and 1000 parts by weight of tetrahydrofuran were added to the dispersion, and the mixture was dispersed at 60 rpm for a whole day and night to obtain a homogeneous photosensitive dispersion.

This photosensitive dispersion was dip-coated on an aluminum drum having a diameter of 120 mm, followed by drying at 100° C. for 1 hour, to form a photosensitive layer having a thickness of 12μ on the aluminum drum.

(2) Test of Photosensitive Material

The photosensitive drum prepared in (1) above was attached to a copying machine (Model DC-121 supplied by Mita Industrial Co., Ltd.), current injected from a transfer charger into the photosensitive drum was set at values shown below and the transfer efficiency was measured with respect to each set value while checking whether or not the memory effect was caused. The obtained results are shown below.

TABLE

| Injected Current I (μA) | I/Io | Transfer Efficiency (%) | Memory |
|---|---|---|---|
| 7.3 | 7.3 | 20.5 | not caused |
| 16.0 | 16.0 | 43.9 | not caused |
| 23.0 | 23.0 | 67.6 | not caused |
| 28.5 | 28.5 | 70.0 | not caused |
| 35.0 | 35.0 | 70.0 | not caused |
| 40.0 | 40.0 | 70.0 | caused |

TABLE-continued

| Injected Current I (μA) | I/Io | Transfer Efficiency (%) | Memory |
|---|---|---|---|
| 55.0 | 55.0 | 70.0 | caused |

Note
Io represents the injected current initiating the transfer (1 μA).

As is apparent from the foregoing results, if the set injected current is adjusted within the range specified in the present invention ($23 \leqq I/Io \leqq 35$), the transfer efficiency can be maintained at a high level without causing a memory effect.

I claim:

1. In an electrophotographic process including providing an organic photoconductive photosensitive layer capable of being charged at both positive and negative polarities, performing main charging of said layer by direct current corona discharge, imagewise exposing the thus charged layer to form an electrostatic image, developing said electrostatic image with a magnetic brush of toner at a polarity opposite to that of said main charging to thereby form a toner image on said layer, bringing a copy sheet into contact with said layer having thereon said toner image, transferring said toner image to said copy sheet by applying to the back of said copy sheet direct current discharge of the same polarity as that of said main charging, and removing from said layer residual toner remaining after said transferring by contacting said layer with said magnetic brush, the improvement comprising:

applying the current of said direct current discharge to perform said transferring at a level 23 to 35 times the current to initiate transfer of said toner; and after said transferring of said toner image and before said removing said residual toner, subjecting said layer to direct current corona discharge of a polarity opposite to that of said main charging and thereby charging said residual toner at a uniform polarity.

2. A process according to claim 1, comprising providing as said organic photoconductor photosensitive layer an electrically conductive substrate having formed thereon a layer of a dispersion of a charge-generating pigment in a charge-transporting medium.

3. A process according to claim 2, wherein said charge-generating pigment is at least one member selected from the group consisting of perylene pigments, quinacridone pigments, pyranthrone pigments, phthalcyanine pigments, dis-azo pigments and tris-azo pigments.

4. A process according to claim 2, wherein said charge-transporting medium is a charge-transporting resin such as polyvinly carbozole or a dispersion of a low-molecular-weight charge-transporting substance such as a hydrazone derivative or pyrazoline derivative in a resin.

5. A process according to claim 1, comprising providing as said organic photoconductor photosensitive layer a layer of a dispersion on N,N'-di-(3,5-dimethylphenyl)-perylene-3,4,9,10-tetracarboxylic acid imide as a charge-generating pigment in a charge-transporting medium composed mainly of polyvinly carbozole.

* * * * *